US008141943B2

(12) United States Patent
Hu et al.

(10) Patent No.: US 8,141,943 B2
(45) Date of Patent: Mar. 27, 2012

(54) CHILDREN'S CHAIR

(75) Inventors: Jun-Jie Hu, Taipei (TW); Wen-Qu Hu, Taipei (TW); Shun-Min Chen, Taipei (TW)

(73) Assignee: Wonderland Nurserygoods Company Limited, Central (HK)

( * ) Notice: Subject to any disclaimer, the term of this patent is extended or adjusted under 35 U.S.C. 154(b) by 407 days.

(21) Appl. No.: 12/503,080

(22) Filed: Jul. 15, 2009

(65) Prior Publication Data

US 2010/0181806 A1 Jul. 22, 2010

(30) Foreign Application Priority Data

Jan. 22, 2009 (CN) ..... 2009 1 0003397

(51) Int. Cl.
*A47D 1/02* (2006.01)

(52) U.S. Cl. ..... 297/16.1; 297/55; 297/344.14; 297/344.18

(58) Field of Classification Search ..... 297/16.1, 297/55, 58, 344.14, 344.18
See application file for complete search history.

(56) References Cited

U.S. PATENT DOCUMENTS 5,104,180 A 4/1992 Takahashi
5,165,755 A * 11/1992 Rho ..... 297/344.18
5,445,432 A * 8/1995 Chien ..... 297/344.18
5,707,104 A 1/1998 Perego
6,050,643 A * 4/2000 Kain et al. ..... 297/344.18
6,126,236 A 10/2000 Wu
6,161,898 A * 12/2000 Brevi ..... 297/328
6,877,801 B2 * 4/2005 Asbach et al. ..... 297/16.1
6,951,371 B2 * 10/2005 Wang ..... 297/344.14
7,029,064 B2 * 4/2006 Chen ..... 297/16.1
7,128,367 B2 * 10/2006 You et al. ..... 297/344.1
7,334,836 B2 2/2008 Chen
7,753,448 B2 * 7/2010 Chen et al. ..... 297/344.18
2003/0218366 A1 * 11/2003 Rho ..... 297/153

FOREIGN PATENT DOCUMENTS

CN 200963010 Y 10/2007

* cited by examiner

*Primary Examiner* — Peter R. Brown
(74) *Attorney, Agent, or Firm* — Winston Hsu; Scott Margo

(57) ABSTRACT

Children's chair having a height adjusting device and a folding device completes folding up by height adjusting. A first leg frame of the children's chair includes a first upper leg and a first lower leg capable moving relatively. When operating the height adjusting device to adjust the first upper leg relative to the first lower leg, an actuator on the first upper leg pushes a slider of the folding device, which locates at the pivot of the first leg frame and a second leg frame. The slider then interferes with a coupler locating at the second leg frame to disengage from a base mounted on the first leg frame. The second leg frame is then rotatable relative to the first leg frame and may be folded to a folding position. The children's chair is easy to perform height adjustment and folding movement by simply operating a button at the handle.

20 Claims, 11 Drawing Sheets

CHILDREN'S CHAIR

BACKGROUND OF THE INVENTION

1. Field of the Invention

The present invention relates to a children's chair, and more specifically, to a children's chair capable of folding the frame in height adjusting.

2. Description of the Prior Art

Children's chairs designed for babies or toddlers have brought great convenience to care givers. With their designed height, babies sitting in the seats are tall enough for a sitting care giver to feed them or have interaction. Most conventional children's chairs are foldable, which is done by folding the frame to a smaller size. The seats can also be detached from the frame for further compaction, and also for modulated manufacturing requirement. Besides, those children's chairs are also equipped with height adjustability to meet various nursing needs from the care givers.

In order to provide foldability for the children's chairs, many ways have been disclosed in the prior art, by the ways of assembling the front leg frame and the rear leg frame, and unlocking the two leg frames so that they can move to each other. For example, the U.S. Pat. No. 6,126,236, U.S. Pat. No. 5,104,180, and U.S. Pat. No. 7,334,836B2 add a transverse supportive frame between the front leg frame and the rear leg frame in the children's chair. The supportive frame, with fixed length, fixes to the front leg frame and the rear leg frame and maintains the relative position between the front leg frame and the rear leg frame. With different mechanism provided by each patent, users can operate an engagement device at the supportive frame and the front leg frame (or the rear leg frame) to disengage the engagement of the supportive frame on the front leg frame (or the rear leg frame). The two leg frames of the children's chair can then be folded. A foldable supportive frame linking between the bottoms of the front leg frame and the rear leg frame is disclosed in the U.S. Pat. No. 5,707,104. In the unfolding status of the children's chair, the supportive frame can not be folded and the front leg frame and the rear leg frame can be maintained in the unfolding status. The user can step on an actuator of the supportive frame on the rear leg frame to fold the supportive frame, and further fold the front and rear leg frames.

The conventional children's chairs mentioned above and in the prior art, however, needs an additional supportive frame or pipe transversely disposed between the front leg frame and the rear leg frame, and requires direct operation on a folding device at the supportive frame/pipe to fold the children's chair.

SUMMARY OF THE INVENTION

The invention provides a children's chair that can actuate a folding device between the front leg frame and the rear leg frame by adjusting the height of the seat to a predetermined position. The user can fold the children's chair in one operation and need not further operate the folding device.

The invention provides a children's chair. The children's chair includes a seat, a frame, and a folding device. The frame supports the seat and includes a first leg frame and a second leg frame rotatably connected with each other. The second leg frame is rotatable relative to the first leg frame between an unfolding position and a folding position. The first leg frame includes a first lower leg and a first upper leg slidably mounted on the first lower leg. The folding device includes an actuator disposed at the first upper leg, and a locking device disposed at the first lower leg and rotatably connected with the second leg frame for retaining the second leg frame at the unfolding position. When the first upper leg slides relative to the first lower leg until the actuator activates locking device, the locking device unlocks the second leg frame so that the second leg frame is rotatable relative to the first leg frame to the folding position.

The invention also provides a children's chair. The children's chair includes a seat, a frame, a locking device, an operating device, and an engaging device. The frame includes a first leg frame and a second leg frame pivotally connected to the first leg frame. The first leg frame includes a first lower leg and a first upper leg slidably mounted on the first lower leg. The seat is disposed at the first upper leg. The locking device connects the first leg frame and the second leg frame for locking or unlocking the second leg frame relative to the first leg frame. The actuating device includes an actuator disposed at the first upper leg. The engaging device is operably disposed at the first lower leg between a first position and a second position, wherein the first upper leg is retained relative to the first lower leg at the first position and the first upper leg is slidable relative to the first lower leg at the second position. When the engaging device is operated from the first position to the second position and the first upper leg is moved relative to the first lower leg, the actuator is moved with the first upper leg to activate the locking device so as to unlock the second leg frame from the first leg frame.

The invention also provides a children's chair. The children's chair includes a seat, a frame for supporting the seat, and a locking device. The frame includes a first leg frame and a second leg frame. The first leg frame includes a first lower leg and a first upper leg slidably mounted on the first lower leg at one of a plurality of positions. The locking device connects the first lower leg and the second leg frame and is convertible between a locking state which the first and the second leg frames are locked relative to each other at an unfolding position, and an unlocking state which the second leg frame is rotatable relative to the first lower leg to a folding position. When the first upper leg moves relative to the first lower leg to a lowest position, the locking device is activated by the first upper leg and convertible from the locking state to the unlocking state.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
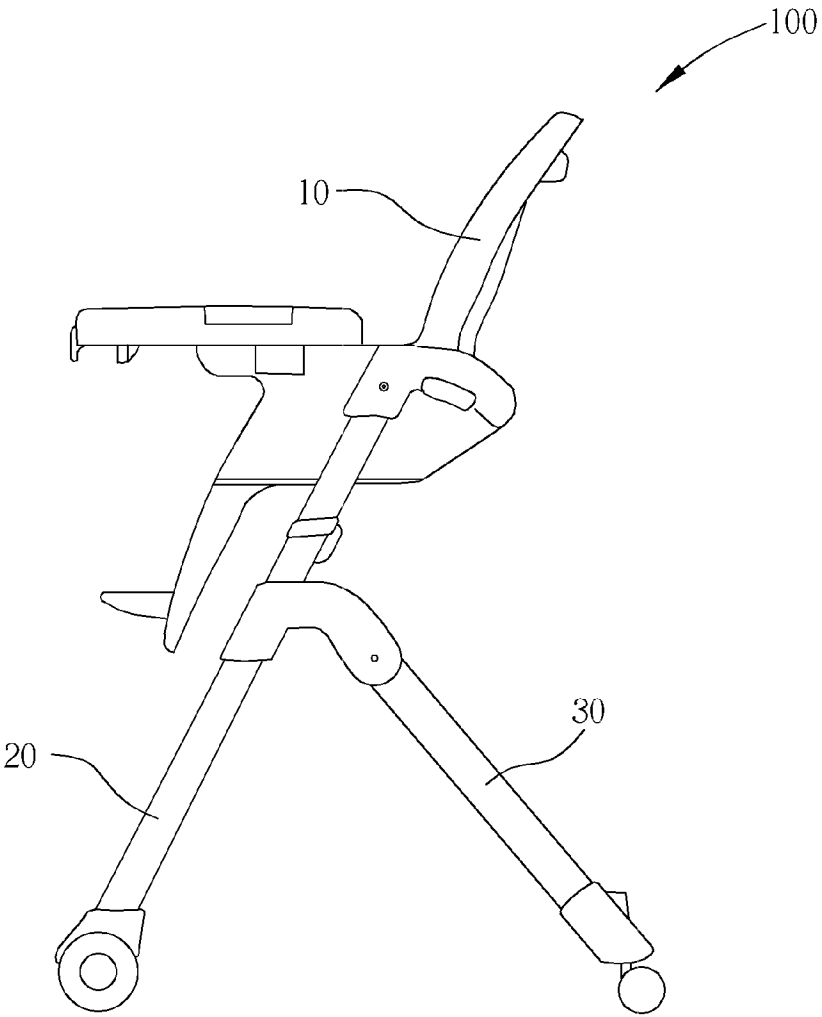
FIG. 1 is an illustration of a children's chair according to the present invention.
Figure 2:
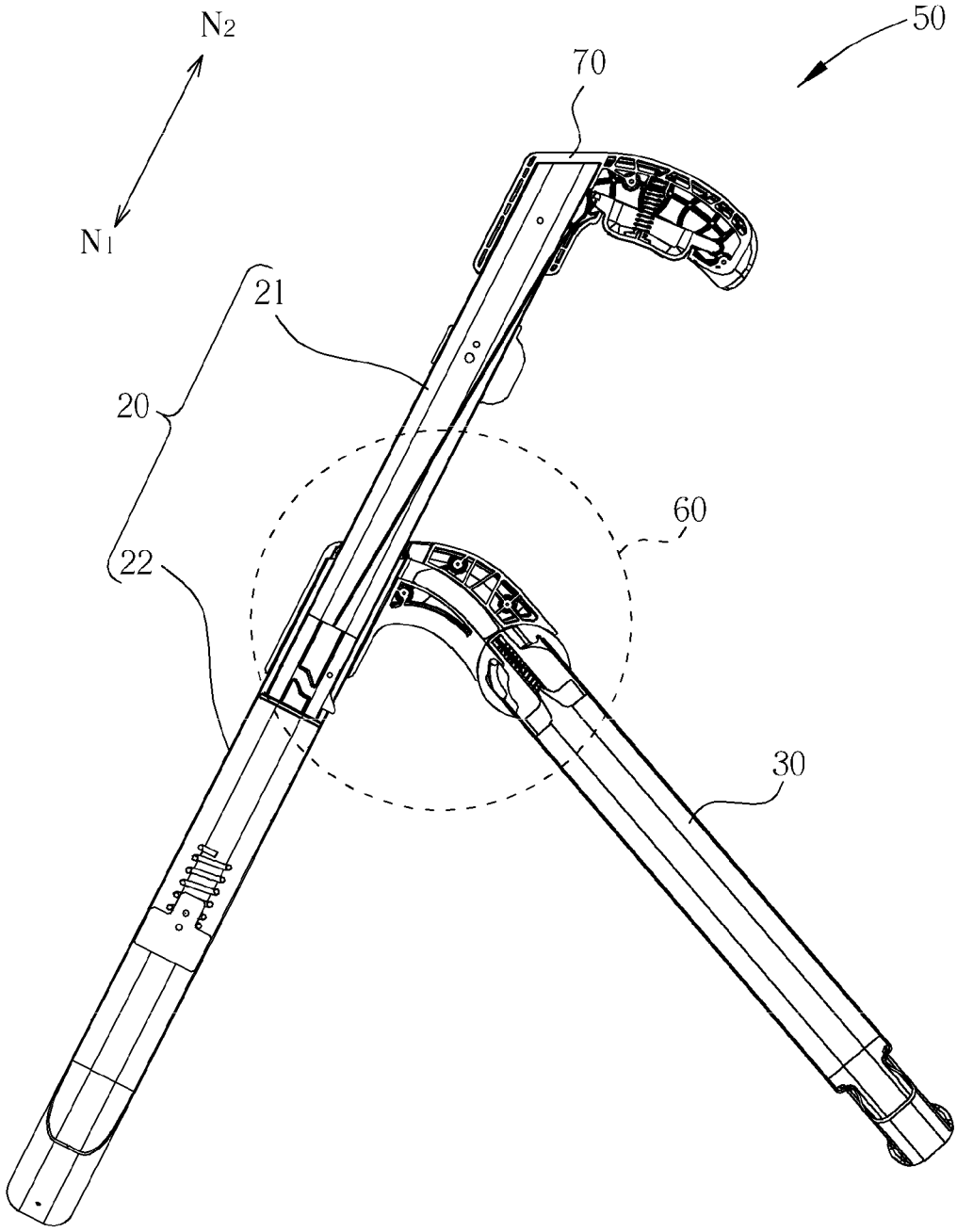
FIG. 2 is an illustration of a frame including a folding device.
Figure 6:
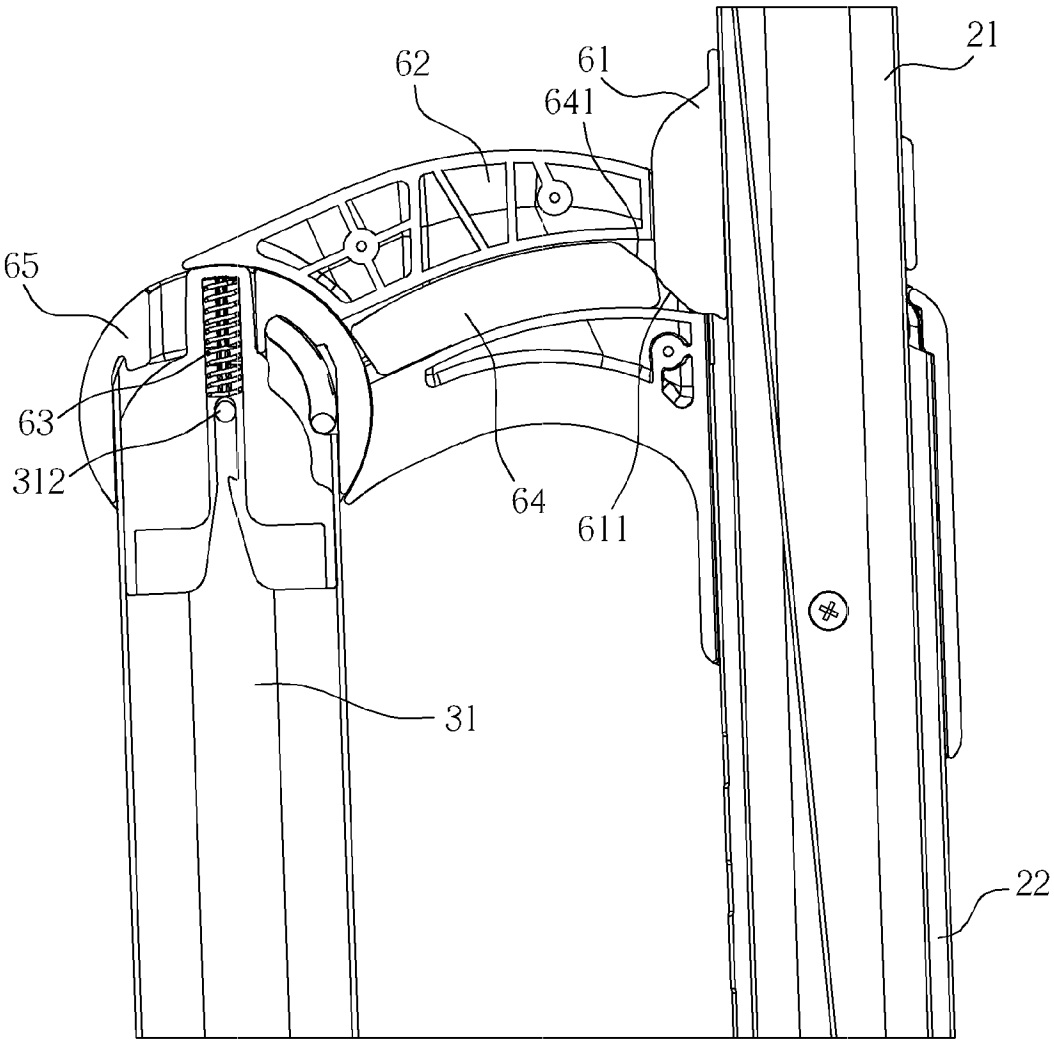
FIG. 6 is an illustration of the second leg frame folded to the first leg frame.

Please refer to FIG. 1 and FIG. 2. FIG. 1 is an illustration of a children's chair 100 according to the present invention, and FIG. 2 is an illustration of a frame 50 including a folding device 60. The children's chair 100 includes a frame 50 including a first leg frame 20 and a second leg frame 30, a folding device 60 (shown in FIG. 2) rotatable connected with the first leg frame 20 and the second leg frame 30, a height adjusting device 80 (shown in FIG. 7), and a seat 10 supported by the frame 50. A handle 70 can further be disposed on the frame 50 where an actuating device 800 of the height adjusting device 80 can locate in the handle 70, which is shown in FIG. 8. When the children's chair 100 is in an unfolding position, a baby can be placed on the seat 10, with a suitable height supported by the frame 50 of the children's chair 100 for a care giver to take care of the baby sitting on the seat 10. The seat 10 can be detached from the frame 50 for storage in this embodiment, and for other embodiments of the present invention, the seat 10 can also be fixedly mounted on the frame 50. The first leg frame 20 and the second leg frame 30 of the frame 50 can be U-shape pipes or including two parallel pipes. The first leg frame 20 and the second leg frame 30 assemble to each other in a pivotal way and the folding device 60 is disposed at the pivot where the second leg frame 30 is rotatably connected with the first leg frame 20. The second leg frame 30 can pivot about the first leg frame 20 via the folding device 60, and be secured in an unfolding position as shown in FIG. 1 or FIG. 2, or in a folding position as shown in FIG. 6 for compacting the children's chair 100 to a smaller size. The seat 10 can further be removed from the frame 50 if needed.

As shown in FIG. 2, the first leg frame 20 includes a first upper leg 21 and a first lower leg 22. The seat 10 is disposed at the first upper leg 21 that can move relative to the first lower leg 22 along directions $N_1$ or $N_2$ via the height adjusting device 80. The children's chair 100 is therefore height adjustable. Besides, the children's chair 100 according to this embodiment of the present invention can fold up in process of height adjusting.

Figure 3:
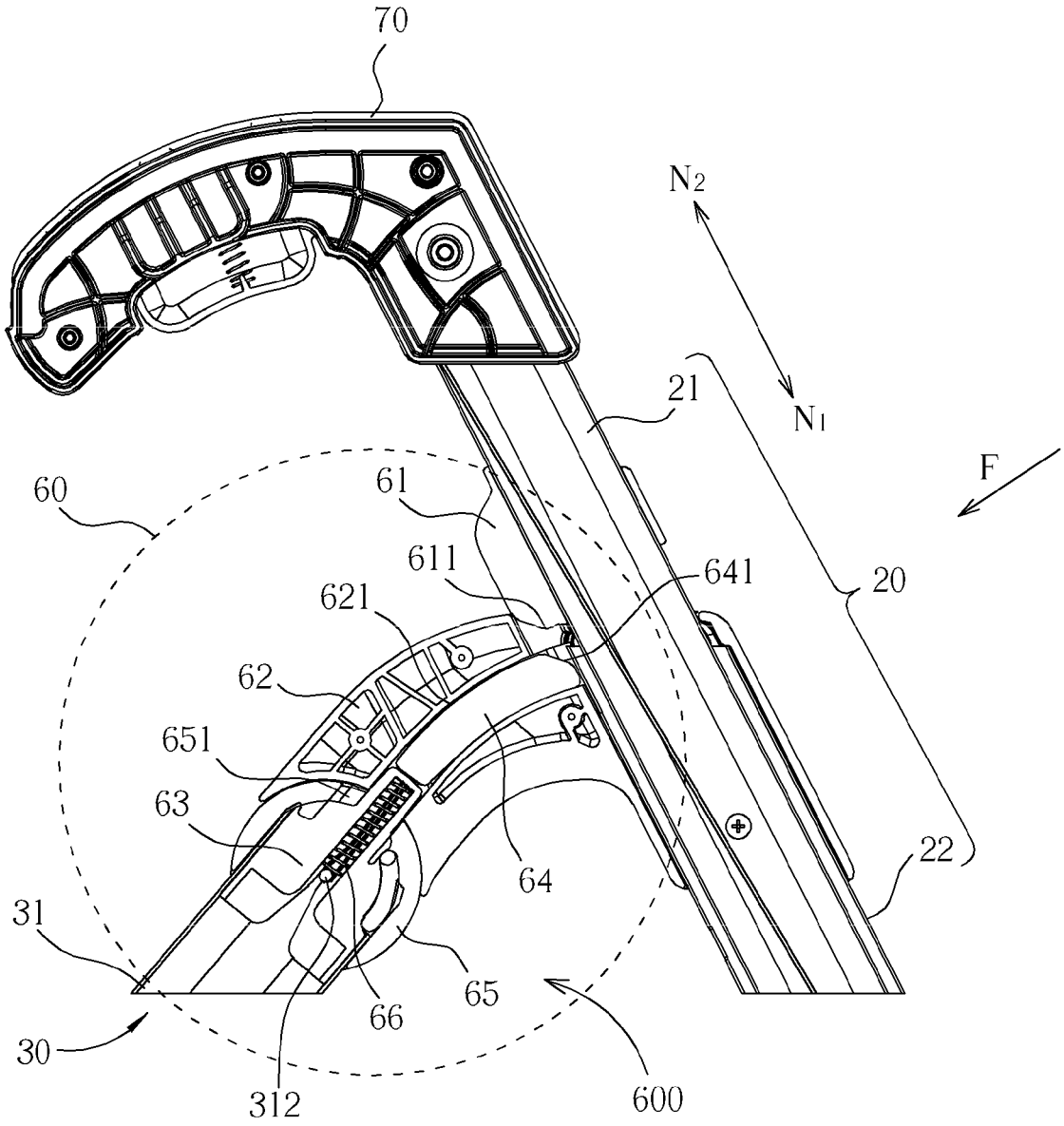
FIG. 3 is an illustration of the folding device of the children's chair that secures a second leg frame on a first leg frame.
Figure 4:
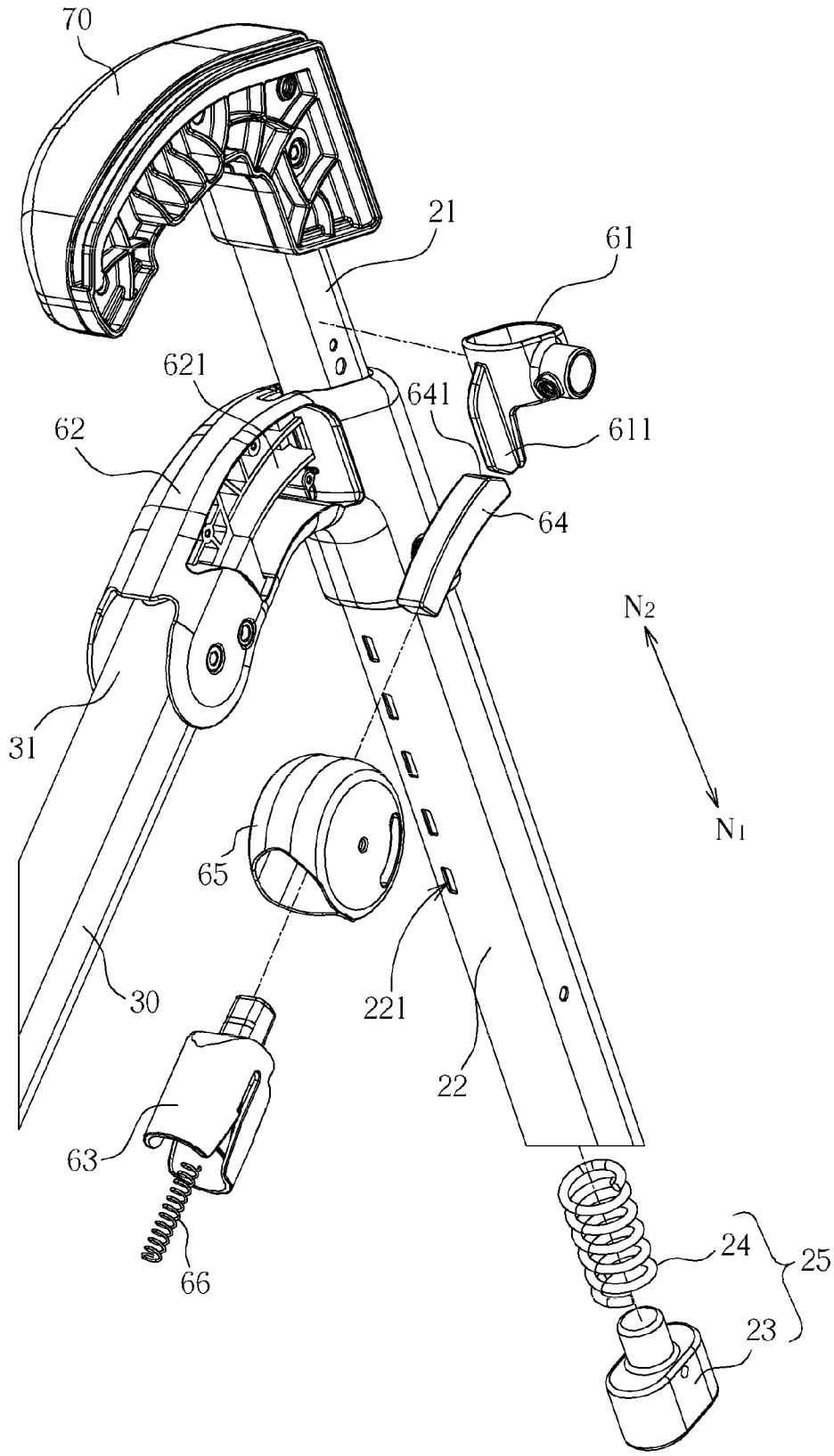
FIG. 4 is an explosive view of the folding device.
Figure 5:
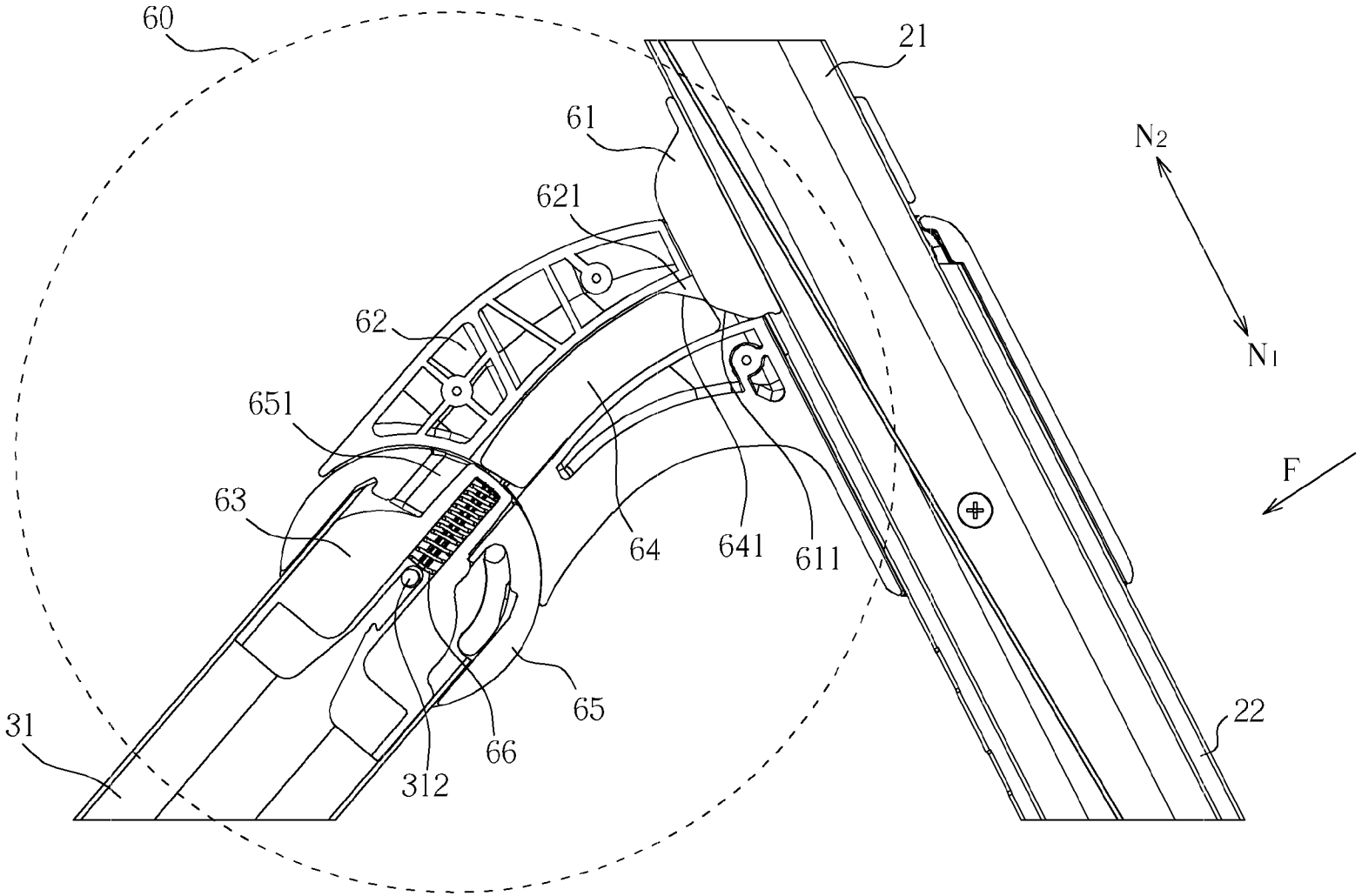
FIG. 5 is an illustration of the folding device in the unlocking position.
Figure 10:
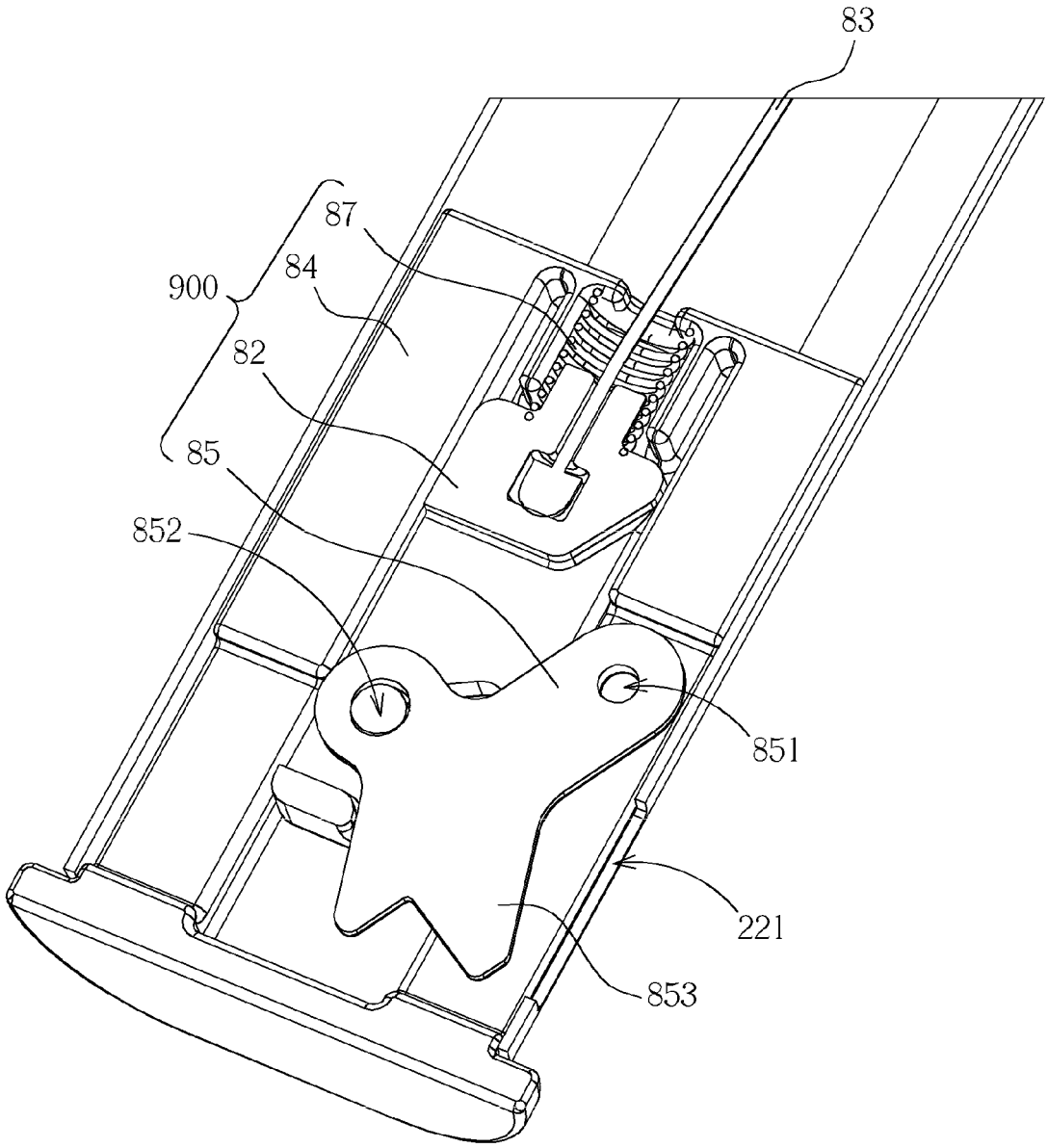
FIG. 10 is an illustration of the height adjusting device in an unlocking status.

Please refer to FIG. 3 and FIG. 4. FIG. 3 is an illustration of the folding device 60 of the children's chair 100, and FIG. 4 is an explosive view of the folding device 60. The folding device 60 is in a locking status that secures the second leg frame 30 to the first leg frame 20 in FIG. 3, meaning that the second leg frame 30 is incapable of rotating relative to the first leg frame 20 and secured in the unfolding position. The folding device 60 includes an actuator 61 and a locking device 600. FIG. 3 shows that the locking device 600 includes a base 62, a coupler 63, a slider 64, a housing 65, and a spring 66. The actuator 61 may be a protrusion, or a protruding piece fixed at the first upper leg 21 in this embodiment. The actuator 61 may be detachable as shown in FIG. 4 and mounted at an arbitrary position on the first upper leg 21 so that the folding device 60 can be activated when the first upper leg 21 moves to a certain position relative to the first lower leg 22. For example, when the actuator 61 is disposed at a position near the handle 70 on the first upper leg 21, as shown in FIG. 3, the actuating device 800 can be activated so that the height of the children's chair 100 is adjusted. The actuator 61 does not push the coupler 63 locating inside the folding device 60 and fold the frame 50 until the hook component 85 moves along direction $N_1$ to the lowermost stepping slot 221, as shown in FIG. 10. Accidentally folding of the children's chair 100 can be avoided. The locking device 600 is configured disposed at the first lower leg 22 and rotatably connected with to the second leg frame 30. The base 62 of the locking device 600 is mounted at the upper end of the first lower leg 22, and the housing 65 connects to a pivot end 31 of the second leg frame 30, also rotatably connected with the base 62. The housing 65 along with the second leg frame 30 can therefore pivot on the base 62 and the first leg frame 20. The base 62 includes a channel 621 that extends along direction F in this embodiment. The slider 64 is slidably disposed in the channel 621 and can move along direction F inside the channel 621. The coupler 63 is disposed at the pivot end 31 of the second leg frame 30, and locates in the housing 65, and can extend out and retract relative to the pivot end 31 of the second leg frame 30, to a locking position as shown in FIG. 3 or an unlocking position as shown in FIG. 5. The spring 66 connects the a fixed part 312 and the coupler 63, wherein the spring 66 has a restoring force for the coupler 63 when the coupler 63 moves inward the pivot end 31 and presses the spring 66. Preferably, the fixed part 312 is a rivet connecting the housing 65 and the second leg frame 30.

FIG. 3 shows that when the coupler 63 of the folding device 60 is set in the locking position, extending out of an opening 651 of the housing 65 and into the channel 621 of the base 62, the coupler 63 withstands the walls of the channel 621, and the housing 65 and the connected second leg frame 30 can not rotate relative to the base 62 and the first leg frame 20. The locking device 600 secures the second leg frame 30 of the frame 50 in the unfolding position.

Please refer to FIG. 5. FIG. 5 is an illustration of the folding device 60 in the unlocking position. The height adjusting device 80 are preferably incorporated with the folding device 60 in this embodiment for performing the folding of the children's chair 100 when performing the height adjusting. For the folding device 60 to unlock the frame 50 so as to fold to a compact size, the height adjusting device 80 is used to move the first upper leg 21 toward the first lower leg 22 along direction $N_1$. A first contact surface 611 of the actuator 61 on the first upper leg 21 then interferentially pushes a second contact surface 641 of the slider 64 to cooperate with the slider 64 to slide in the channel 621 along direction F. The other end of the slider 64 then pushes the coupler 63 out of the channel 621. The coupler 63 then fully retracts and locates in the unlocking position as shown in FIG. 5. Folding of the children's chair 100 can be done by pivoting the housing 65 and the second leg frame 30 relative to the base 62 and the first leg frame 20 to a folding position as shown in FIG. 6. Additionally, the spring 66 connecting the coupler 63 and the fixed part 312 is compressed as the coupler 63 is set in the unlocking position in FIG. 5. When the second leg frame 30 rotates relative to the first leg frame 20 from the folding position as in FIG. 6 to the unfolding position as in FIG. 5, and the first upper leg 21 moves away from the first lower leg 22 along direction $N_2$ at the same time to depart the actuator 61 from the base 62, the restoring force from the spring 66 pushes the coupler 63 from the opening 651 of the housing 65 into the channel 621, so that the frame 50 can be secured in the unfolding position again.

Figure 7:
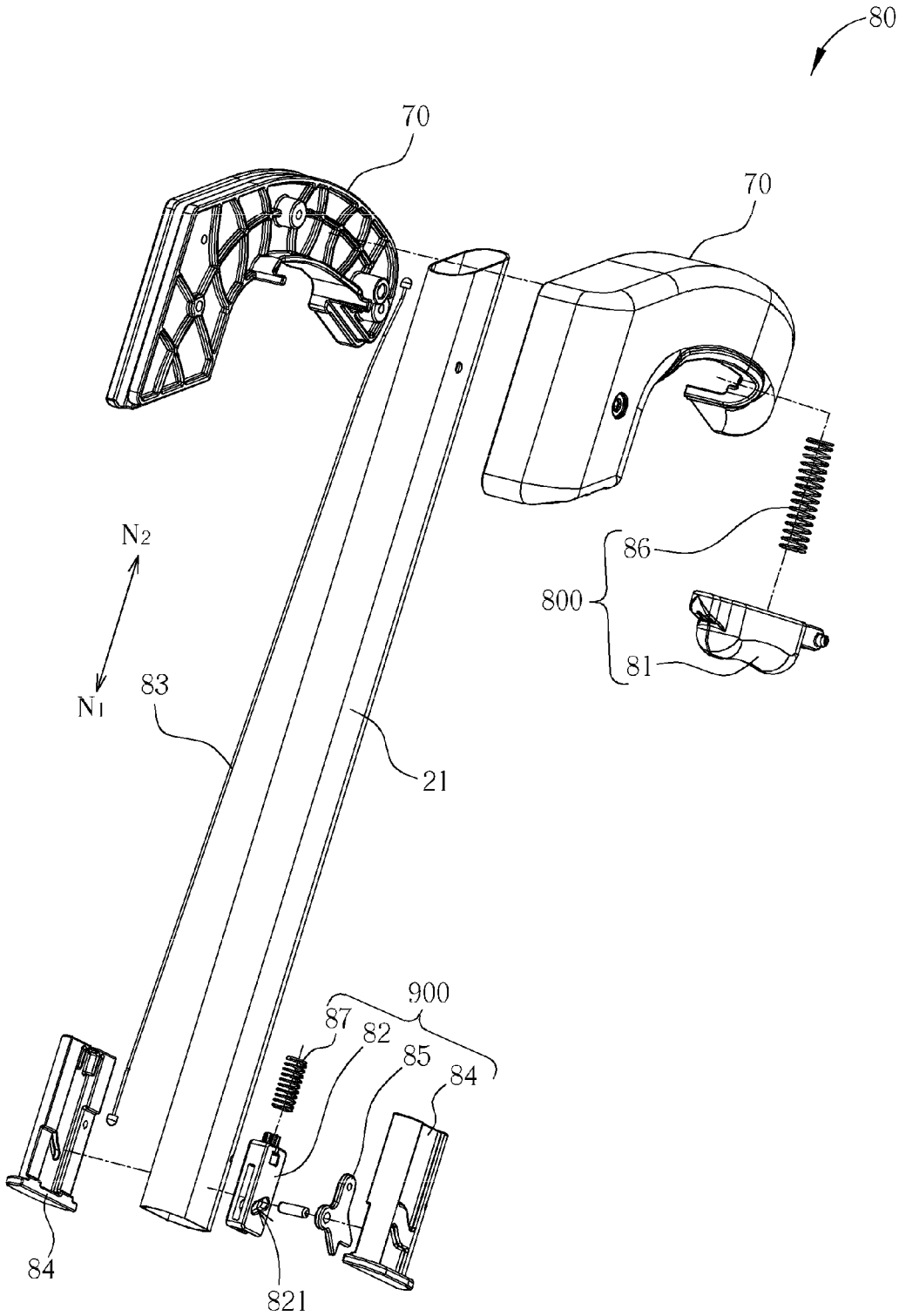
FIG. 7 is an explosive view of the height adjusting device of the children's chair according to the present invention.
Figure 8:
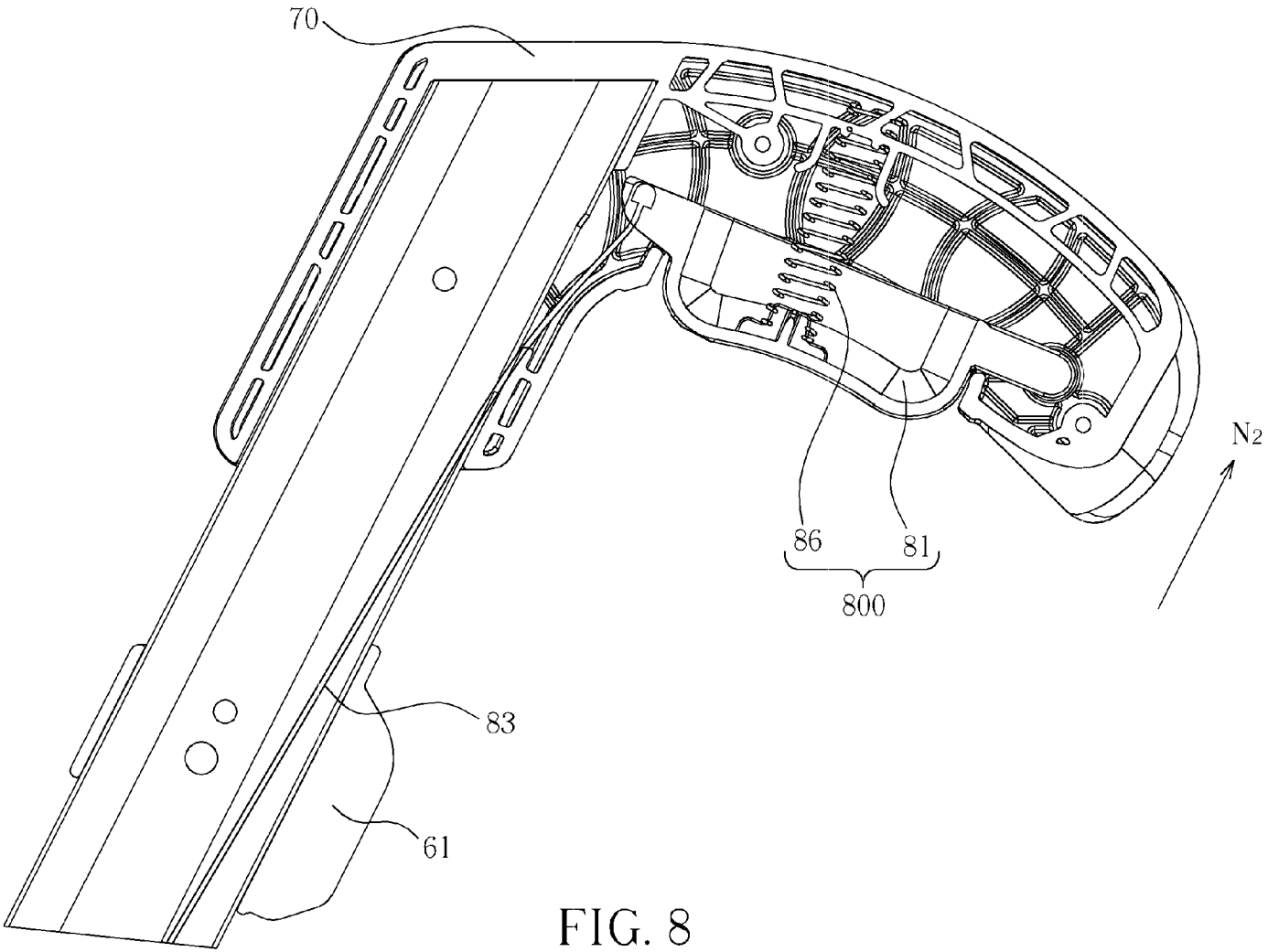
FIG. 8 is an illustration of the actuating device disposed in the handle.
Figure 9:
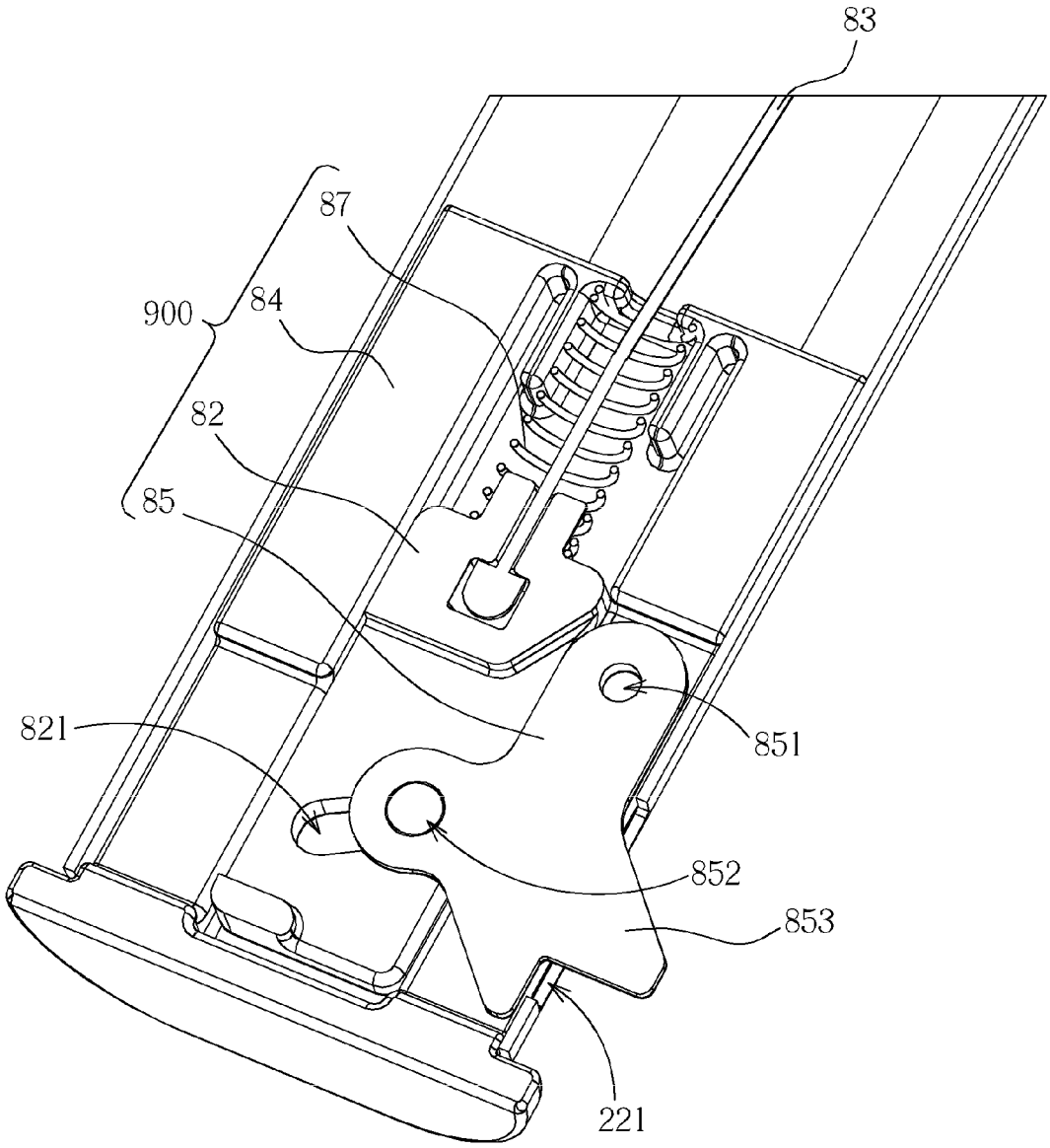
FIG. 9 is an illustration of the height adjusting device in a locking status.
Figure 11:
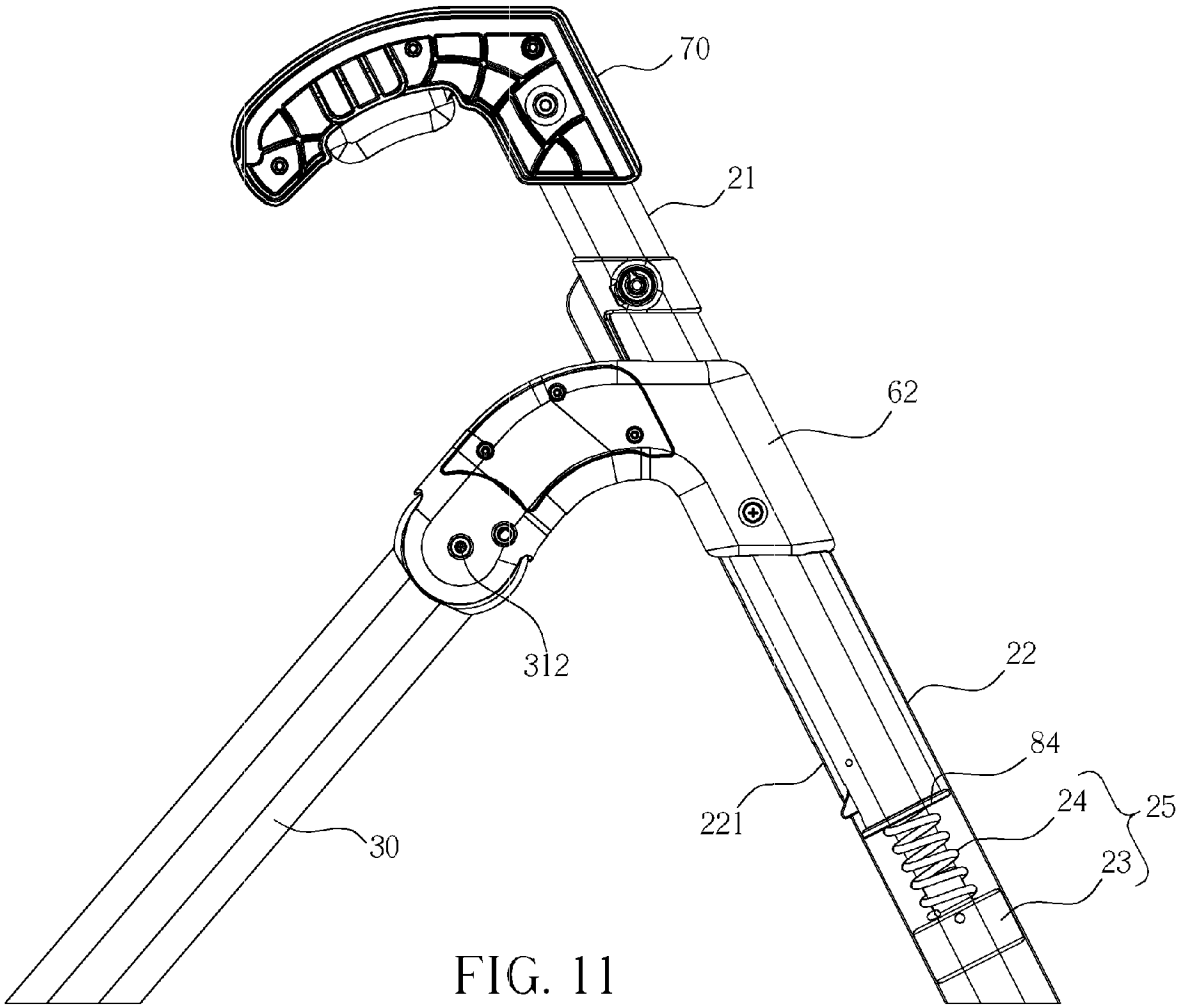
FIG. 11 is an illustration of the first upper leg sliding to a lowest height.

Please refer to FIG. 7. FIG. 7 is an explosive view of the height adjusting device 80 of the children's chair 100 according to the present invention. The height adjusting device 80 includes a plurality of stepping slots 221 (shown in FIG. 4), an actuating device 800, an engaging device 900 and a linkage 83. The actuating device 800 disposed in the handle 70 includes a button 81 and a spring 86. The engaging device 900 includes a moving element 82, a plug 84, a hook component 85 and a spring 87. The button 81 and the spring 86 locating inside the handle 70 are used to adjust relative position of the actuator 61 to the first lower leg 22. The handle 70 is disposed at an end of the first upper leg 21 in this embodiment. The plug 84 is disposed and fixed at the other end of the first upper leg 21. The moving element 82 can have slight movement inside the plug 84 along direction $N_1$ or $N_2$ and have an inclined slit 821, relative to the directions $N_1$, $N_2$. The linkage 83 can be a steel wire in this embodiment and connects the button 81 in the handle 70, shown in FIG. 8, and the moving element 82 in the plug 84. Please also refer to FIG. 9. The hook component 85 can be an iron piece in this embodiment and has an axle 851, a pin 852, and a protruding end 853. The axle 851 is disposed at the plug 84 so that the hook component 85 can rotate on the plug 84 between a first position as shown in FIG. 9 and a second position as shown in FIG. 10. The pin 852 of the hook component 85 extends through the inclined slit 821 of the moving element 82 and can be moved by the moving element 82, having relative movement in the inclined slit 821 so that the hook component 85 rotates along the axle 851. As FIG. 4, FIG. 10, and FIG. 11 show, the first lower leg 22 includes a plurality of stepping slots 221. The protruding end 853 on the hook component 85 extends out of one of the stepping slots 221 when rotating relative to the plug 84 to the first position so that the first upper leg 21 can be restrained relative to the first lower leg 22. The seat 10 is therefore maintained at a certain height.

Please refer to FIG. 8 and FIG. 9. FIG. 8 is an illustration of the actuating device 800 disposed in the handle 80, and FIG. 9 is an illustration showing the height adjusting device 80 in a locking status. As mentioned before, when the hook component 85 rotates to the first position as shown in FIG. 9, the protruding end 853 extends out of one of the stepping slots 221. Please refer to FIG. 10. When height adjustment of the children's chair 100 is required, pushing the button 81 along direction $N_2$ as illustrated in FIG. 8 moves the linkage 83 along direction $N_2$, too. Meanwhile, the spring 86 connecting between the button 81 and the handle 70 is compressed and bears a restoring force for the button 81. Since the pin 852 of the hook component 85 locates in the inclined slit 821 of the moving element 82, the pin 852 is moved by the inclined slit 821 and the hook component 85 is rotated along the axle 851 to the second position, in this embodiment, in a clockwise direction, when the moving element 82 is pulled to move along direction $N_2$. The protruding end 853 disengages from one of the stepping slots 221 during the rotation of the hook component 85, and the first upper leg 21 is now capable of moving to a needed height relative to the first lower leg 22, along direction $N_1$ or $N_2$.

Both the spring 86 in the handle 70 and the spring 87 in the plug 84 are compressed, such that the button 81 and the moving element 82 bear a restoring force respectively when the height adjusting device 80 is set in the unlocking position as shown in FIG. 10. After the first leg frame 20 is adjusted to a needed height, releasing the button 81 allows the spring 86 and the spring 87 to push the button 81 and the moving element 82 to move along direction $N_1$ respectively. Due to the movement of the moving element 82, the pin 852 of the hook component 85 in the inclined slit 821 is moved so that the hook component 85 rotates along the axle 851 to the first position, in this embodiment, in a counterclockwise direction. The protruding end 853 engages with one of the stepping slots 221 again and the height of the first upper leg 21 is maintained.

Please refer to FIG. 11 and FIG. 4. The children's chair 100 in the present invention further includes a buffer device 25 in the first lower leg 22. The buffer device 25 includes a supporter 23 and a buffer spring 24. The supporter 22 is fixed in the first lower leg 22 and the buffer spring 24 is disposed between the supporter 23 and the plug 84. In this embodiment, the stroke design of the height adjusting device 80 requires a user to push the first upper leg 21 into the first lower leg 22 beyond the lowest stepping slot 221 until the bottom of the plug 84 compresses the buffer spring 24. Meanwhile, the actuator 61 interferes with the slider 64 so that the folding device 60 can be unlocked. The restoring force provided by the buffer spring 24 for the plug 84 not only buffers the falling of the first upper leg 21, but prevents accidentally folding of the frame 50 due to the operation that the actuator 61 interferes with the slider 64 unexpectedly.

Furthermore, for a folded frame 50 with the first upper leg 21 locating at a lowest locking position relative to the first lower leg 22, the user can feel the instant bouncing of the first upper leg 21 due to the restoring of the compressed buffer spring 24 after unlocking the first upper leg 21 from the first lower leg 22 by pushing the button 81. Hence, the buffer spring 24 is disposed at a position lower than the lowest stepping slot 221, preferably in this embodiment.

The present invention discloses the children's chair having the height adjusting device and the folding device that may complete folding up by height adjusting. The first leg frame of the children's chair includes the first upper leg and the first lower leg capable moving relatively. When operating the height adjusting device to adjust the first upper leg relative to the first lower leg, the actuator on the first upper leg pushes the slider of the folding device. The slider then interferes with the coupler locating at the second leg frame to disengage from the base mounted on the first leg frame. The second leg frame is then rotatable relative to the first leg frame and may be folded to a folding position. The children's chair is easy to perform height adjustment and folding movement by simply operating a button at the handle.

Those skilled in the art will readily observe that numerous modifications and alterations of the device and method may be made while retaining the teachings of the invention.

The invention claimed is:

1. A children's chair, comprising:

a seat;

a frame for supporting the seat and comprising a first leg frame and a second leg frame rotatably connected with each other, wherein the second leg frame is rotatable relative to the first leg frame between an unfolding position and a folding position, and the first leg frame comprises a first lower leg and a first upper leg slidably mounted on the first lower leg; and a folding device, comprising:

an actuator disposed at the first upper leg; and a locking device disposed at the first lower leg and rotatably connected with the second leg frame for retaining the second leg frame at the unfolding position;

wherein when the first upper leg slides relative to the first lower leg until the actuator activates the locking device, the locking device unlocks the second leg frame so that the second leg frame is rotatable relative to the first leg frame to the folding position.

2. The children's chair of claim 1, wherein the second leg frame comprises a pivot end, and the locking device comprises:

a base disposed at the first lower leg and having a channel, the pivot end of the second leg frame rotatably connected with the base;

a slider slidably disposed in the channel of the base for being pushed by the actuator and moved in the channel; and a coupler disposed at the pivot end, capable of extending out or retracting relative to the pivot end, and cooperating with the slider for moving selectively between an unlocking position and a locking position;

wherein when the coupler moves to the locking position, the coupler extends in the channel of the base and retains the second leg frame at the unfolding position; when the coupler moves to the unlocking position, the coupler moves off the channel and the second leg frame is rotatable relative to the base.

3. The children's chair of claim 2, wherein the actuator comprises a first contact surface and the slider comprises a second contact surface and the actuator pushes the slider by the first contact surface abutting the second contact surface when the actuator moves along with the first upper leg sliding relative to the first lower leg.

4. The children's chair of claim 2, wherein the folding device further comprises a housing connecting to the pivot end, the housing has an opening, and the coupler is capable of extending out or retracting into the opening.

5. The children's chair of claim 2, wherein the second leg frame further comprises a fixed part therein adjacent to the pivot end, the folding device further comprises an elastic element disposing between the fixed part and the coupler;

wherein when the second leg frame is rotated to the folding position, the coupler is moved off the channel by the slider to the unlocking position, and the elastic element is compressed by the coupler and the fixed part to provide the coupler a restoring force;

when the second leg frame is rotated to the unfolding position, the coupler is moved into the channel by the restoring force of the elastic element.

6. The children's chair of claim 1, wherein the actuator is a protrusion abutting against the locking device.

7. The children's chair of claim 1, further comprising a height adjusting device for adjusting the height of the seat, wherein the position of the actuator relative to the first lower leg is adjusted in the process of height adjusting.

8. The children's chair of claim 7, further comprising a handle disposed at the first upper leg, the height adjusting device further adjusting the relative height of the first upper leg to the first lower leg and comprising:

a plurality of stepping slots disposed at the first lower leg;

an actuating device disposed in the handle;

an engaging device disposed in the first upper leg for engaging with one of the stepping slots; and a linkage connecting the actuating device and the engaging device;

wherein the actuating device can be actuated to disengage the engaging device from one of the stepping slots so as to adjust the relative position between the first upper leg and the first lower leg.

9. The children's chair of claim 8, wherein the engaging device comprises:

a moving element having an inclined slit, wherein the linkage connects the moving element and the actuating device, and the actuating device moves the moving element toward the handle via the linkage;

a plug fixed in the first upper leg, the moving element movable in the plug; and a hook component having an axle, a pin, and a protruding end, the hook component rotatably connected with the plug via the axle, the pin extending to and movable in the inclined slit, the protruding end utilized for engaging with one of the stepping slots at the first lower leg;

wherein when the actuating device moves the moving element toward the handle, the inclined slit of the moving element moves the pin of the hook component and rotates the hook component about the axle relative to the plug, and the protruding end disengages from one of the stepping slots at the first lower leg.

10. The children's chair of claim 9, wherein the height adjusting device further comprises an elastic element disposing between the moving element and the plug for providing a restoring force for the moving element when the actuating device moves the moving element toward the handle via the linkage along the first upper leg.

11. The children's chair of claim 9, wherein the hook component is an iron piece.

12. The children's chair of claim 9, further comprising a buffer device disposed in the first lower leg for providing a restoring force for the plug when the first upper leg moves relative to the first lower leg and the plug abuts the buffer device.

13. The children's chair of claim 12, wherein the buffer device comprises a buffer spring and a supporter, the supporter is fixed in the first lower leg, and the buffer spring is disposed between the supporter and the plug.

14. The children's chair of claim 9, wherein the actuating device of the height adjusting device comprises a button and an elastic element, the linkage connects the button and the engaging device, and the elastic element is disposed between the button and the handle for providing a restoring force for the button.

15. A children's chair, comprising:

a seat;

a frame, comprising a first leg frame and a second leg frame pivotally connected to the first leg frame, the first leg frame comprising a first lower leg and a first upper leg slidably mounted on the first lower leg, the seat disposed at the first upper leg;

a locking device connecting the first leg frame and the second leg frame for locking or unlocking the second leg frame relative to the first leg frame; an actuating device, comprising an actuator disposed at the first upper leg, and an engaging device, operably disposed at the first lower leg between a first position and a second position, wherein the first upper leg is retained relative to the first lower leg at the first position and the first upper leg is slidable relative to the first lower leg at the second position;

wherein when the engaging device is operated from the first position to the second position and the first upper leg is moved relative to the first lower leg, the actuator is moved with the first upper leg to activate the locking device so as to unlock the second leg frame from the first leg frame.

16. The children's chair of claim 15, wherein the second leg frame comprises a pivot end, the locking device comprises:

a base disposed at the first lower leg and having a channel, the pivot end of the second leg frame rotatable connected with the base; and a coupler disposed at the second leg frame and telescopically connected to the second leg frame, the coupler cooperating with the actuator for selectively moving between an unlocking position and a locking position;

wherein when the coupler is set in the locking position, the coupler extends into the channel of the base and retains the second leg frame at the unfolding position; when the first upper leg moves relative to the first lower leg such that the actuator moves the coupler off the channel to the unlocking position, and the second leg frame is rotatable relative to the base.

17. The children's chair of claim 16, wherein the locking device further comprises a housing connecting to the second leg frame and having an opening, and the coupler is capable of extending out or retracting into the opening.

18. The children's chair of claim 15, wherein the actuating device further comprises a passive component disposed at the first upper leg, the actuator comprises a first contact surface and the passive component comprises a second contact surface, the actuator pushes the passive component by the first contact surface abutting the second contact surface when the actuator moves along with the first upper leg moving axially to the first lower leg.

19. The children's chair of claim 15, wherein the engaging device comprises:

a moving element having an inclined slit, wherein the linkage connects the moving element and the actuating device, and the actuating device moves the moving element via the linkage;

a plug fixed in the first upper leg, the moving element movable in the plug; and a hook component having an axle, a pin, and a protruding end, the hook component rotatably connected with the plug via the axle, the pin extending to and movable in the inclined slit, the protruding end utilized for engaging with one of stepping slots at the first lower leg;

wherein when the actuating device moves the moving element, the inclined slit of the moving element moves the pin of the hook component and rotates the hook component about the axle relative to the plug, and the protruding end disengages from one of the stepping slots at the first lower leg.

20. A children's chair, comprising:

a seat;

a frame for supporting the seat, wherein the frame comprises a first leg frame and a second leg frame, the first leg frame comprising a first lower leg and a first upper leg slidably mounted on the first lower leg at one of a plurality of positions; and a locking device connecting the first lower leg and the second leg frame and convertible between a locking state which the first and the second leg frames are locked relative to each other at an unfolding position, and an unlocking state which the second leg frame is rotatable relative to the first lower leg to a folding position;

wherein when the first upper leg moves relative to the first lower leg to a lowest position, the locking device is activated by an actuator of the first upper leg and convertible from the locking state to the unlocking state.

* * * * *